US010937577B2

(12) United States Patent
Sakuma et al.

(10) Patent No.: US 10,937,577 B2
(45) **Date of Patent: *Mar. 2, 2021**

(54) MAGNETIC COMPOUND AND PRODUCTION METHOD THEREOF

(71) Applicant: TOYOTA JIDOSHA KABUSHIKI KAISHA, Toyota (JP)

(72) Inventors: Noritsugu Sakuma, Mishima (JP); Masao Yano, Sunto-gun (JP); Akira Kato, Mishima (JP); Akira Manabe, Miyoshi (JP); Shunji Suzuki, Iwata (JP); Kurima Kobayashi, Fukuroi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 953 days.

This patent is subject to a terminal disclaimer.

(21) Appl. No.: 15/233,362

(22) Filed: Aug. 10, 2016

(65) Prior Publication Data

US 2017/0084370 A1 Mar. 23, 2017

(30) Foreign Application Priority Data

Sep. 17, 2015 (JP) ..... 2015-184368

(51) Int. Cl.
*C22C 38/14* (2006.01)
*H01F 1/055* (2006.01)
(Continued)

(52) U.S. Cl.
CPC ..... *H01F 1/0557* (2013.01); *C22C 38/005* (2013.01); *C22C 38/10* (2013.01);
(Continued)

(58) Field of Classification Search
CPC ..... H01F 41/0253
See application file for complete search history.

(56) References Cited

U.S. PATENT DOCUMENTS 4,971,637 A 11/1990 Ohashi et al.
5,456,769 A 10/1995 Sakurada et al.
(Continued)

FOREIGN PATENT DOCUMENTS

CN 104916382 A 9/2015
JP H06-235051 A 8/1994
(Continued)

OTHER PUBLICATIONS

Yang, Ying-chang et al., "Magnetic and crystallographic properties of novel Fe-rich rare-earth nitrides of the type RTiFe11N-? (invited)", Journal of Applied Physics, Nov. 15, 1991, vol. 70, No. 10, pp. 6001-6005.

(Continued)

*Primary Examiner* — Jophy S. Koshy
(74) *Attorney, Agent, or Firm* — Oliff PLC

(57) ABSTRACT

A magnetic compound represented by the formula $(R^1_{(1-x)}R^2_x)_a(Fe_{(1-y)}Co_y)_bT_cM_d$ wherein $R^1$ is one or more elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo, Si and W, M is one or more elements selected from the group consisting of unavoidable impurity elements, Al, Cr, Cu, Ga, Ag and Au, $0 \le x \le 0.7$, $0 \le y \le 0.7$, $4 \le a \le 20$, $b=100-a-c-d$, $0<c<7.7$, and $0 \le d \le 3$, the magnetic compound having a $ThMn_{12}$-type crystal structure, wherein the volume fraction of α-(Fe, Co) phase is less than 12.3%.

12 Claims, 7 Drawing Sheets

(51) Int. Cl.

| | |
|---|---|
| *C22C 38/10* | (2006.01) |
| *C22C 38/00* | (2006.01) |
| *H01F 1/059* | (2006.01) |
| *H01F 41/02* | (2006.01) |

(52) U.S. Cl.
CPC ..... *C22C 38/14* (2013.01); *H01F 1/055* (2013.01); *H01F 1/0593* (2013.01); *H01F 41/0293* (2013.01)

(56) References Cited

U.S. PATENT DOCUMENTS

| | | | | |
|---|---|---|---|---|
| 5,478,411 | A * | 12/1995 | Coey | C23C 8/06 148/102 |
| 5,480,495 | A | 1/1996 | Sakurada et al. | |
| 6,511,552 | B1 | 1/2003 | Makita et al. | |
| 10,325,704 | B2 | 6/2019 | Sakuma et al. | |
| 10,351,935 | B2 | 7/2019 | Sakuma et al. | |
| 2001/0020495 | A1* | 9/2001 | Mei | H01F 1/0306 148/301 |
| 2013/0020527 | A1 | 1/2013 | Li et al. | |
| 2015/0262740 | A1 | 9/2015 | Fujiwara et al. | |
| 2016/0071635 | A1* | 3/2016 | Sakuma | H01F 1/0593 252/62.51 R |
| 2018/0062455 | A1 | 3/2018 | Hagiwara et al. | |

FOREIGN PATENT DOCUMENTS

| | | | |
|---|---|---|---|
| JP | H06-283316 | A | 10/1994 |
| JP | H06-342706 | A | 12/1994 |
| JP | 2001-189206 | A | 7/2001 |
| JP | 2004-265907 | A | 9/2004 |
| JP | 2006-183151 | A | 7/2006 |
| JP | 2013-157487 | A | 8/2013 |

OTHER PUBLICATIONS

Yang, Ying-chang et al., "Intrinsic magnetic properties of SmTiFe10", Journal of Applied Physics, Apr. 15, 1988, vol. 63, No. 8, pp. 3702-3703.

Satoshi Sugimoto et al. "Enhancement of Magnetic Properties of Sm(Fe, Co, Ti)12 Melt-Spun Ribbons by Refining Crystallized Grains". Materials Transactions, The Japan Institute of Metals, vol. 32, No. 12, 1991, pp. 1180-1183.

Hirayama et al., "NdFe12Nx Hard-Magnetic Compound with High Magnetization and Anisotropy Field," Science Direct, Scripta Materialia, 2015, vol. 95, pp. 70-72.

Jan. 5, 2018 Office Action issued in U.S. Appl. No. 14/844,478.

Oct. 15, 2018 Office Action issued in U.S. Appl. No 14/844,478.

Thaddeus B. Massalski, "Binary Alloy Phase Diagrams", II Ed, Dec. 1990, pp. 1479-1480.

Y. Wang et al., "Magnetic and Structural Studies in Sm-Fe—Ti Magnets", Journal of Applied Physics, 1990, pp. 4954-4956, vol. 67, No. 9.

Mar. 6, 2019 Notice of Allowance issued in U.S. Appl. No. 15/380,079.

* cited by examiner

MAGNETIC COMPOUND AND PRODUCTION METHOD THEREOF

TECHNICAL FIELD

The present invention relates to a magnetic compound having a $ThMn_{12}$-type crystal structure and having high an anisotropic magnetic field and high saturation magnetization, and a production method thereof.

BACKGROUND ART

The application of a permanent magnet is expanding to a wide range of fields including electronics, information and telecommunications, medical cares, machine tools, and industrial and automotive motors, and while an increasing demand for reduction in the amount of carbon dioxide emission has encouraged spreading of hybrid vehicle, energy saving in the industrial field, enhancement of power generation efficiency, etc., expectations for development of a high-characteristic permanent magnet are recently further growing.

An Nd—Fe—B-based magnet currently dominating the market as a high-performance magnet is also used as a magnet for a drive motor of EV/PHV/HV. These days, more miniaturization and higher power output (increase in the residual magnetization of a magnet) of a motor are pursued, and in response thereto, a new permanent magnet material is being developed.

As one material having performance surpassing that of an Nd—Fe—B magnet, a rare earth-iron-based magnetic compound having a $ThMn_{12}$-type crystal structure is currently being studied. For example, a nitride magnetic composition containing Nd as a rare earth element and having a $ThMn_{12}$-type crystal structure has been proposed in *J. Appl. Phys.,* 70(10), 6001 (1991), and a magnetic composition containing Sm as a rare earth element and having a $ThMn_{12}$-type crystal structure has been proposed in *J. Appl. Phys.,* 63(8), 3702 (1988).

SUMMARY OF THE INVENTION

In the conventionally known compounds having a $NdFe_{11}TiN_x$ composition containing a $ThMn_{12}$-type crystal structure, uniaxial magnetic anisotropy is developed by N and therefore, the anisotropic magnetic field is high. However, since N desorbs at a high temperature of 600° C. or more to decrease the anisotropic magnetic field, it has been difficult to achieve a high performance by full densification such as sintering. On the other hand, an $SmFe_{11}Ti$ compound containing Sm above is substantially free of N and is advantageous in view of full densification. However, sufficiently high magnetic properties have not been heretofore obtained by the $SmFe_{11}Ti$ compound.

An object of the present invention is to provide a magnetic compound having both high anisotropic magnetic field and high magnetization, which can solve the problems in the related arts above.

In order to attain the object above, according to the present invention, the followings are provided.

(1) A magnetic compound represented by the formula:

$$(R^1_{(1-x)}R^2_x)_a(Fe_{(1-y)}Co_y)_bT_cM_d$$

wherein $R^1$ is one or more elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo, Si and W, M is one or more elements selected from the group consisting of unavoidable impurity elements, Al, Cr, Cu, Ga, Ag and Au, $0 \le x \le 0.7$, $0 \le y \le 0.7$, $4 \le a \le 20$, $b = 100 - a - c - d$, $0 < c < 7.7$, and $0 \le d \le 3$, the magnetic compound having a $ThMn_{12}$-type crystal structure, wherein the volume fraction of α-(Fe, Co) phase is less than 12.3%.

(2) The magnetic compound according to (1), wherein when hexagons A, B and C are defined as:

A: a six-membered ring centering on a rare earth atom $R^1$ and consisting of Fe (8i) and Fe(8j) sites, B: a six-membered ring centering on an Fe (8i)-Fe (8i) dumbbell and consisting of Fe (8i) and Fe(8j) sites, and C: a six-membered ring centering on an Fe (8i)- rare earth atom line and consisting of Fe (8j) and Fe(8f) sites, the $ThMn_{12}$-type crystal structure has these hexagons A, B and C and the length in the axis a direction of hexagon A is 0.612 nm or less.

(3) A method for producing the magnetic compound according to (1), including:

a step of preparing a molten alloy having a composition represented by the formula:

$$(R^1_{(1-x)}R^2_x)_a(Fe_{(1-y)}Co_y)_bT_cM_d$$

wherein $R^1$ is one or more elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo, Si and W, M is one or more elements selected from the group consisting of unavoidable impurity elements, Al, Cr, Cu, Ga, Ag and Au, $0 \le x \le 0.7$, $0 \le y \le 0.7$, $4 \le a \le 20$, $b = 100 - a - c - d$, $0 < c < 7.7$, and $0 \le d \le 3$, and a step of quenching the molten alloy at a rate of $1 \times 10^2$ to $1 \times 10^7$ K/sec.

The method according to (3), further including a step of performing a heat treatment at 800 to 1,300° C. for 2 to 120 hours after the quenching step.

MODE FOR CARRYING OUT THE INVENTION

The magnetic compound according to the present invention is described in detail below. The magnetic compound of the present invention is a magnetic compound represented by the following formula:

$$(R^1_{(1-x)}R^2_x)_a(Fe_{(1-y)}Co_y)_bT_cM_d$$

and each constituent component is described below.

($R^1$)

Figure 1:
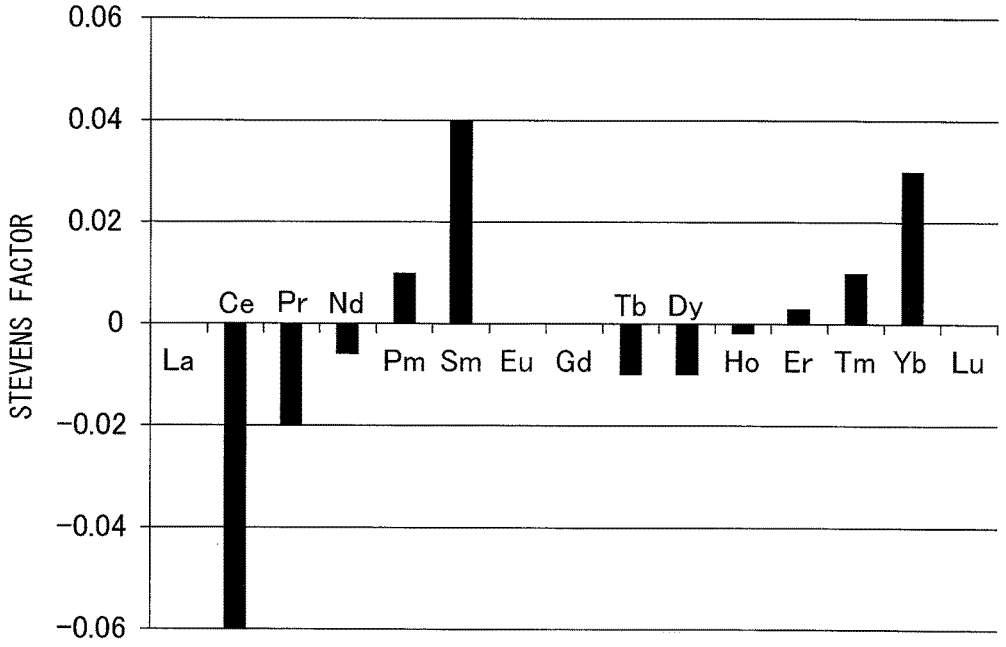
FIG. 1 is a graph illustrating various rare earth elements and the values of the Stevens factor thereof.

$R^1$ is a rare earth element having a positive Stevens factor and is an essential component in the magnetic compound of the present invention so as to develop permanent magnet characteristics. In FIG. 1, various rare earth elements and the values of the Stevens factor thereof are illustrated. Specifically, $R^1$ is one or more elements selected from the group consisting of Sm, Pm, Er, Tm and Yb each having a positive Stevens factor illustrated in FIG. 1, and it is particularly preferable to use Sm having a high value of the Stevens factor.

The Stevens factor is a parameter depending on the spatial distribution geometry of 4f electrons and takes a fixed value according to the kind of the rare earth ion $R^{3+}$. The 4f electron shows a characteristic spatial distribution according to the number of the electrons and in the case of $Gd^{3+}$ ion having seven 4f electrons, seven 4f orbitals are filled with 4f electrons having seven upward spins and since the orbital magnetic moments cancel one another and become 0, the existence probability of 4f electrons produces a spherical distribution. On the other hand, for example, in the case of $Nd^{3+}$ or Dy, since the Stevens factor is negative, the spatial distribution of 4f electrons is distorted relative to axis z that is a symmetry axis, and the existence probability of 4f electrons has a flat profile. On the contrary, for example, in the case of $Sm^{3+}$, since the Stevens factor is positive, the spatial distribution of 4f electrons extends relative to axis z that is a symmetry axis, and the existence probability of 4f electrons has an oblong profile.

In the case of using a rare earth element having a negative Stevens factor, spin is not fixed due to a flat profile of the existence probability of 4f electrons, and nitridation needs to be performed so as to produce uniaxial anisotropy, but a sintering step cannot be used at the time of manufacture of a full-dense magnet (because sintering performed at a high temperature causes nitrogen leakage at the high temperature during sintering or makes the $ThMn_{12}$ structure unstable at the high temperature, resulting in decomposition into a rare earth nitride and α-Fe), and the usage remains at the level of bonded magnet. On the other hand, in the case of using a rare earth magnet having a positive Stevens factor, it is known that uniaxial anisotropy is developed, and nitridation need not be performed.

($R^2$)

$R^2$ is Zr or one or more elements selected from the group consisting of La, Ce, Pr, Nd, Eu, Gd, Tb, Dy, Ho and Lu in which the Stevens factor is negative or zero, and contributes to stabilization of the $ThMn_{12}$-type crystal phase by substituting for part of the rare earth element $R^1$. More specifically, $R^2$, particularly, Zr element, substitutes for $R^1$ element in the $ThMn_{12}$-type crystal to cause shrinkage of a crystal lattice and thereby acts to stably maintain the $ThMn_{12}$-type crystal phase when the temperature of an alloy is raised or a nitrogen atom, etc. is entered into a crystal lattice. In addition, one or more elements selected from the group consisting of La, Ce, Pr, Nd, Eu, Gd, Tb, Dy, Ho and Lu in which the Stevens factor is negative or zero, bear little resource risk compared with Sm and consequently, by replacing part of the rare earth site by La, etc., a magnet more reduced in the resource risk can be manufactured. On the other hand, from the standpoint of magnetic properties, since the strong magnetic anisotropy derived from $R^1$ element is weakened by $R^2$ substitution, the $R^2$ amount must be determined by taking into account the stability of crystal and the magnetic properties. However, in the present invention, addition of $R^2$ is not essential. The $R^2$ amount x is $0 \le x \le 0.7$, and when the $R^2$ amount is 0, the $ThMn_{12}$-type crystal phase can be stabilized, for example, by adjusting the component composition of alloy and performing a heat treatment, which in turn increases the anisotropic magnetic field. If the $R^2$ substitution amount exceeds 0.7, the anisotropic magnetic field significantly decreases. The $R^2$ amount x is preferably $0 \le x \le 0.4$.

The total blending amount a of $R^1$ and $R^2$ is set to be from 4 to 20 atom %, because if the blending amount is less than 4 atom %, precipitation of Fe phase becomes significant, and the volume fraction of Fe phase cannot be decreased after heat treatment, whereas if the blending amount is more than 20 atom %, magnetization is not improved due to an excessively large amount of grain boundary phase. The total blending amount a of $R^1$ and $R^2$ is preferably $4 \le a \le 15$.

(T)

T is one or more elements selected from the group consisting of Ti, V, Mo, Si and W. It is known that when Ti, V, Mo, Si or W is added as a third element to an R—Fe binary alloy (R: a rare earth element), the $ThMn_{12}$-type crystal structure is stabilized and excellent magnetic properties are exhibited.

Conventionally, the $ThMn_{12}$-type crystal structure is formed by adding a T component in a large amount more than necessary to an alloy so as to obtain the stabilization effect of this component and therefore, the content by percentage of the Fe component constituting the compound in the alloy is decreased. At the same time, the site occupied by Fe atom having a largest effect on magnetization is replaced, for example, by Ti atom, leading to reduction in the entire magnetization. The magnetization may be enhanced by decreasing the blending amount of Ti, but in this case, stabilization of the $ThMn_{12}$-type crystal structure is deteriorated. As the conventional $RFe_{12-x}Ti_x$ compound, $RFe_{11}Ti$ has been reported, but a compound in which x is less than 1, i.e., Ti is less than 7.7 atom %, has not been reported.

When the amount of Ti acting to stabilize the $ThMn_2$-type crystal structure is decreased, stabilization of the $ThMn_{12}$-type crystal structure is deteriorated, and α-(Fe, Co) working out to a hindrance to the anisotropic magnetic field or coercive force precipitates. In the present invention, it is made possible to reduce the amount of α-(Fe, Co) precipitated by controlling the cooling rate of molten alloy and even when the blending amount of the T component is decreased, stably produce a $ThMn_{12}$ phase having high magnetic properties by adjusting the volume fraction of α-(Fe, Co) phase in the compound to a certain value or less.

The blending amount of the T component is an amount satisfying x of less than 1 in the $RFe_{12}$-$xTi_x$ compound, i.e., less than 7.7 atom %. If the blending amount is 7.7 atom % or more, the content by percentage of the Fe component constituting the compound is decreased, and the entire magnetization is reduced. The blending amount c of the T component is preferably $3.8 \leq c \leq 7.7$.

(M)

M is one or more elements selected from the group consisting of unavoidable impurity elements, Al, Cr, Cu, Ga, Ag and Au. The unavoidable impurity element means an element entering into the raw material or an element getting mixed with in the production process and, specifically, includes B, C, N, O, H, P and Mn. M contributes to suppressing the grain growth of $ThMn_{12}$-type crystal as well as to the viscosity and melting point of a phase other than the $ThMn_{12}$-type crystal (for example, a grain boundary phase) but is not essential in the present invention. The blending amount d of M is 3 atom % or less, preferably 2 atom % or less. If the blending amount is more than 3 atom %, the content by percentage of the Fe component constituting the compound in the alloy is decreased, and the entire magnetization is reduced.

(Fe and Co)

In the compound of the present invention, the remainder other than the above-described elements is Fe, and part of Fe may be substituted by Co. By substituting for Fe, Co can cause an increase in the spontaneous magnetization according to the Slater-Pauling Rule and enhance both properties of anisotropic magnetic field and saturation magnetization. However, if the Co substitution amount exceeds 0.7, the effects cannot be brought out. When Fe is substituted by Co, the Curie point of the compound rises, and this produces an effect of suppressing reduction in the magnetization at a high temperature. The Co substitution amount y is preferably $0 \leq y \leq 0.4$.

The magnetic compound of the present invention is characterized by being represented by the formula above and having a $ThMn_{12}$-type crystal structure. This $ThMn_{12}$-type crystal structure is tetragonal and shows peaks at 2θ values of 29.801°, 36.554°, 42.082°, 42.368°, and 43.219° (±0.5°) in the XRD measurement results. Furthermore, the magnetic compound of the present invention is characterized in that the volume fraction of α-(Fe, Co) phase is less than 12.3%, preferably 10% or less, more preferably 8.4% or less. This volume fraction is calculated from the area percentage of the α-(Fe, Co) phase in a cross-section by image analysis after a sample is embedded in a resin, polished and observed by OM or SEM-EDX. Here, when it is assumed that the structure is not randomly oriented, the following relational expression is established between the average area percentage A and the volume percentage V.

A=about V

In the present invention, the thus-measured area percentage of the α-(Fe, Co) phase is taken as the volume fraction.

As described above, in the magnetic compound of the present invention, the anisotropic magnetic field can be increased by using, as a rare earth element, an element having a positive Stevens factor and magnetization can be enhanced by decreasing the content of the T component as compared to the conventional $RFe_{11}Ti$-type compound. In addition, the anisotropic magnetic field can be improved by setting the volume fraction of the α-(Fe, Co) phase to be as small as less than 12.3%.

(Crystal Structure)

Figure 2:
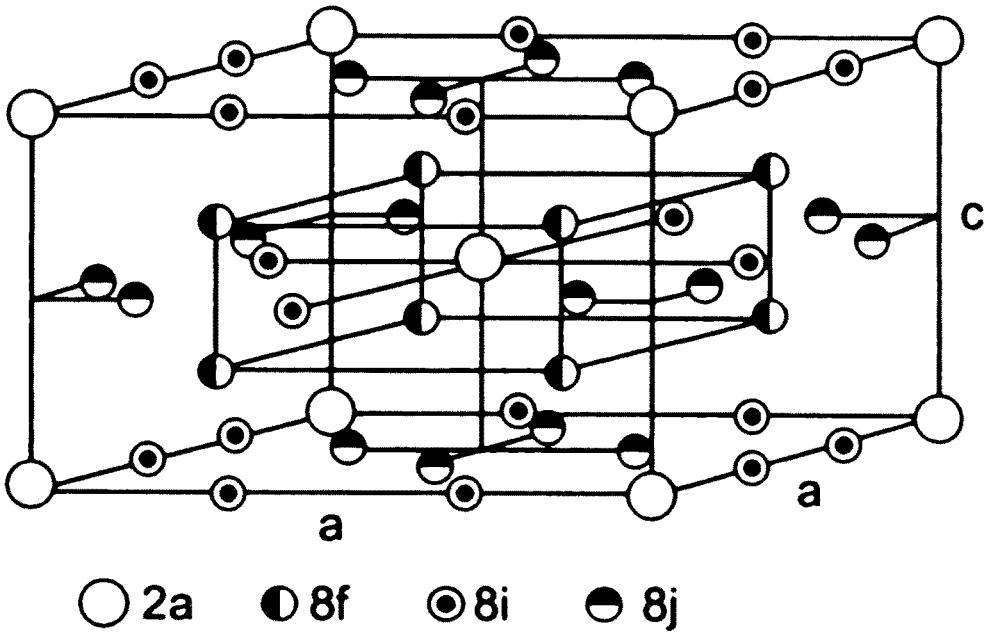
FIG. 2 is a perspective view schematically illustrating the $ThMn_{12}$-type crystal structure.
Figure 3A:
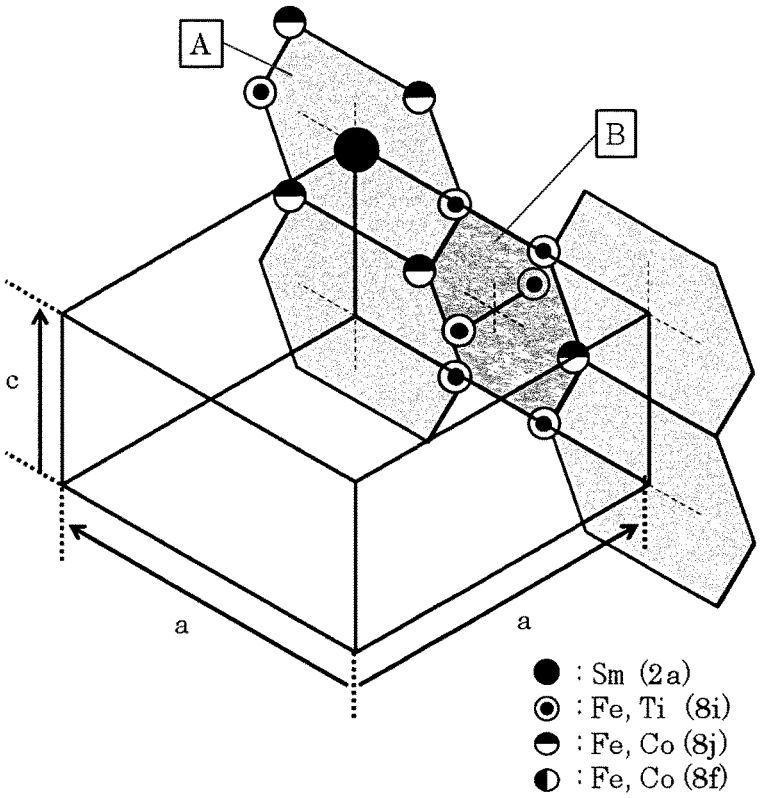
FIGS. 3(*a*) and 3(*b*) are perspective views schematically illustrating hexagons A, B and C in the $ThMn_{12}$-type crystal structure.
Figure 3B:
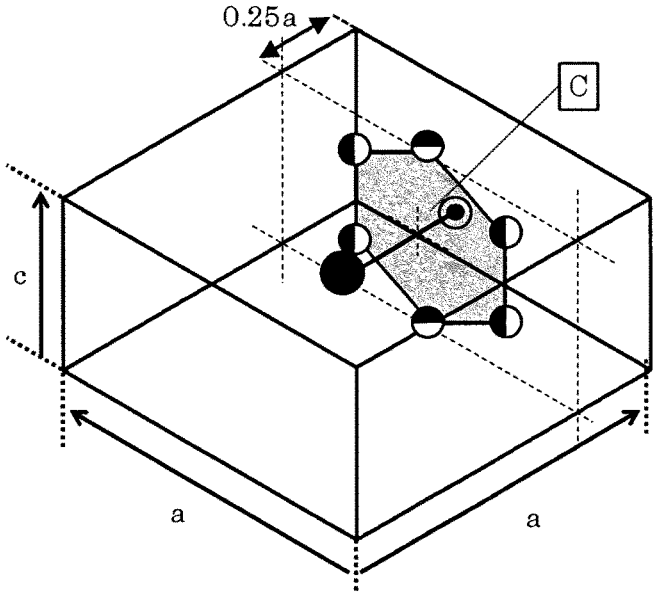

The magnetic compound of the present invention is a rare earth element-containing magnetic compound having a $ThMn_{12}$-type tetragonal crystal structure illustrated in FIG. 2. This is a magnetic compound where as illustrated in FIG. 3, when hexagons A, B and C are defined as:

A: a six-membered ring centering on a rare earth atom $R^1$ and consisting of Fe (8i) and Fe(8j) sites (FIG. 3(*a*)), B: a six-membered ring centering on an Fe (8i)-Fe (8i) dumbbell and consisting of Fe (8i) and Fe(8j) sites (FIG. 3(*a*)), and C: a six-membered ring centering on an Fe (8i)- rare earth atom line and consisting of Fe (8j) and Fe(8f) sites (FIG. 3(*b*)), the length in the axis a direction of hexagon A: Hex(A) is 0.612 nm or less.

Figure 4:
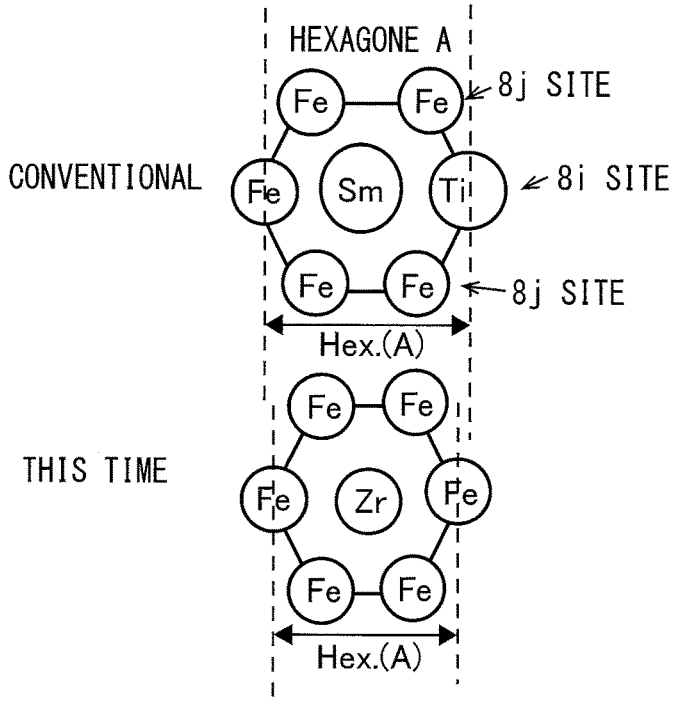
FIG. 4 is a view schematically illustrating the change in size of the hexagon.

As illustrated in FIG. 4, in the magnetic compound of the present invention where the proportion of T (for example, Ti) as a stabilization element is small and Ti having a large atomic radius is replaced by Fe, compared with the conventional magnetic compound, the shape or dimension balance of hexagon A is deteriorated, but the deterioration is compensated for with Zr, etc. having a smaller atomic radius than Sm, and the shape or dimension balance is thereby adjusted.

(Production Method)

The magnetic compound of the present invention can be basically produced by a conventional production method such as die casting method or arc melting method, but in the conventional method, a large amount of a stable phase (α-(Fe, Co) phase) except for the $ThMn_{12}$ phase is precipitated to decrease the anisotropic magnetic field. In the present invention, focusing attention on the relationship of temperature at which the $ThMn_{12}$-type crystal precipitates<temperature at which α-(Fe, Co) precipitates, the molten alloy is quenched at a rate of $1\times10^2$ to $1\times10^7$ K/sec and thereby prevented from staying long near the temperature at which α-(Fe, Co) precipitates, so as to reduce the precipitation of α-(Fe, Co) and produce a large amount of the $ThMn_{12}$-type crystal.

Figure 5:
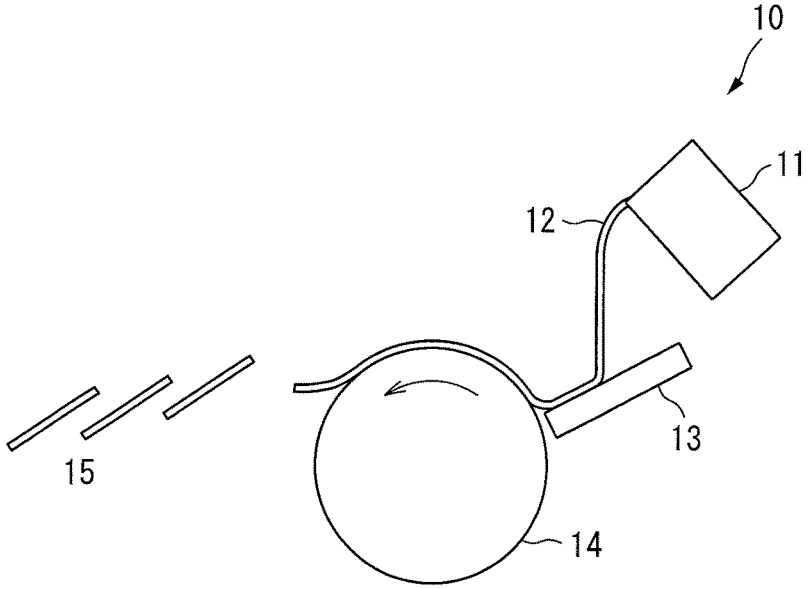
FIG. 5 is a schematic view of the apparatus used in a strip casting method.

As for the cooling method, for example, the molten alloy can be cooled at a predetermined rate, for example, by a strip casting method or a super-quenching method, by using an apparatus 10 illustrated in FIG. 5. In the apparatus 10, alloy raw materials are melted in a melting furnace 11 to prepare a molten alloy 12 having a composition represented by the formula $(R^1_{(1-x)}R^2_x)_a(Fe_{(1-y)}Co_y)_bT_cM_d$. In the formula above, $R^1$ is one or more elements selected from the group consisting of Sm, Pm, Er, Tm and Yb, $R^2$ is one or more elements selected from the group consisting of Zr, La, Ce, Pr, Nd, Eu, Gd, Tb, Dy, Ho and Lu, T is one or more elements selected from the group consisting of Ti, V, Mo and W, M is one or more elements selected from the group consisting of unavoidable impurity elements, Al, Cr, Cu, Ga, Ag and Au, $0 \leq x \leq 0.7$, $0 \leq y \leq 0.7$, $4 \leq a \leq 20$, b=100-a-c-d, $0<c<7.7$, and $0 \leq d \leq 3$. This molten alloy 12 is supplied to a tundish 13 at a fixed supply rate. The molten alloy 12 supplied to the tundish 13 is continuously supplied to a cooling roller 14 through a tapping hole at the end or bottom of the tundish 13.

The tundish 13 is composed of alumina, zirconia or ceramic such as calcia and can temporarily store the molten alloy 12 continuously supplied from the melting furnace 11 at a predetermined flow rate and rectify the flow of the molten alloy 12 to the cooling roller 14. The tundish 13 also has a function of adjusting the temperature of the molten alloy 12 immediately before reaching the cooling roller 14.

The cooling roller 14 is formed of a material having high thermal conductivity, such as copper or chromium alloy, and the roller surface is subjected to chromium plating, etc. so as to prevent corrosion from the high-temperature molten alloy. This roller is rotated by a driving device (not shown) at a predetermined rotational speed in the arrow direction. The cooling rate of the molten alloy can be controlled to a rate of $1\times10^2$ to $1\times10^7$ K/sec by controlling the rotational speed.

The molten alloy 12 cooled and solidified on the outer circumference of the cooling roller 14 turns into a flaky solidified alloy 15 and is separated from the cooling roller 14, crushed and collected in a collection device.

In the present invention, the method may further includes a step of heat-treating the particle obtained in the step above at 800 to 1,300° C. for 2 to 120 hours. By this heat treatment, the $ThMn_{12}$ phase is homogenized, and both properties of anisotropic magnetic field and saturation magnetization are further enhanced.

EXAMPLES

Examples 1 to 3 and Comparative Examples 1 to 9

Molten alloys aimed for the manufacture of a compound having the composition shown in Table 1 below were prepared, and each was quenched at a rate of $10^4$ K/sec by a strip casting method to prepare a quenched flake. The flake was subjected to a heat treatment in an Ar atmosphere at 1,200° C. for 4 hours and then crushed by means of a cutter mill in an Ar atmosphere, and particles having a particle diameter of 30 μm or less were collected. The size and area percentage of α-(Fe, Co) phase were measured from an SEM image (reflection electron image) of the obtained particle, and the volume percentage was calculated assuming that area percentage=volume percentage. In addition, magnetic characteristic evaluation (VSM) and crystal structure analysis (XRD) of the obtained particle were performed. The results are shown in Table 1 and FIGS. 6 and 7.

TABLE 1

| | Composition | Ti Amount [atom %] | Size of α(Fe, Co) (μm) | Volume Percentage of α(Fe, Co) (%) | Anisotropic Magnetic Field [MA/m] | Saturation Magnetization @RT (T) | Saturation Magnetization @180° C. (T) | Hex. (A) (nm) |
|---|---|---|---|---|---|---|---|---|
| Example 1 | $Sm_{7.7}(Fe_{0.75}Co_{0.25})_{88.5}Ti_{3.8}$ | 3.8 | 1.3 | 5.5 | 6.1 | 1.61 | 1.60 | 0.612 |
| Example 2 | $(Sm_{0.8}Zr_{0.2})_{7.7}(Fe_{0.75}Co_{0.25})_{86.5}Ti_{5.8}$ | 5.8 | <1 | <3.5 | 6.4 | 1.51 | 1.50 | 0.607 |
| Example 3 | $(Sm_{0.8}Ce_{0.1}Zr_{0.1})_{7.7}(Fe_{0.75}Co_{0.25})_{86.5}Ti_{5.8}$ | 5.8 | <1 | <3.5 | 5.9 | 1.5 | 1.49 | 0.611 |
| Comparative Example 1 | $(Nd_{0.7}Zr_{0.3})_{7.7}(Fe_{0.75}Co_{0.25})_{88.5}Ti_{3.8}$ | 3.8 | 1.1 | 3.9 | 1.3 | 1.65 | 1.62 | 0.603 |
| Comparative Example 2 | $Ce_{7.7}(Fe_{0.75}Co_{0.25})_{86.5}Ti_{5.8}$ | 5.8 | <1 | <3.5 | 1.9 | 1.3 | 1.38 | 0.619 |
| Comparative Example 3 | $(Ce_{0.8}Zr_{0.2})_{7.7}(Fe_{0.75}Co_{0.25})_{86.5}Ti_{5.8}$ | 5.8 | <1 | <3.5 | 1.7 | 1.42 | 1.40 | 0.610 |
| Comparative Example 4 | $(Nd_{0.9}Zr_{0.1})_{7.7}(Fe_{0.75}Co_{0.25})_{86.5}Ti_{5.8}$ | 5.8 | <1 | <3.5 | 1.7 | 1.59 | 1.56 | 0.615 |
| Comparative Example 5 | $(Nd_{0.8}Zr_{0.2})_{7.7}(Fe_{0.75}Co_{0.25})_{86.5}Ti_{5.8}$ | 5.8 | <1 | <3.5 | 1.7 | 1.6 | 1.57 | 0.610 |
| Comparative Example 6 | $(Nd_{0.7}Zr_{0.3})_{7.7}(Fe_{0.75}Co_{0.25})_{86.5}Ti_{5.8}$ | 5.8 | <1 | <3.5 | 1.7 | 1.57 | 1.54 | 0.606 |
| Comparative Example 7 | $Sm_{7.7}(Fe_{0.75}Co_{0.25})_{84.6}Ti_{7.7}$ | 7.7 | <1 | <3.5 | 6.7 | 1.32 | 1.30 | 0.618 |
| Comparative Example 8 | $Sm_{7.7}Fe_{84.6}Ti_{7.7}$ | 7.7 | <1 | <3.5 | 6.6 | 1.22 | 1.12 | 0.618 |
| Comparative Example 9 | $Sm_{7.7}Fe_{80.8}Ti_{11.5}$ | 11.5 | <1 | <3.5 | 6.8 | 1.19 | 1.09 | 0.623 |

Figure 6:
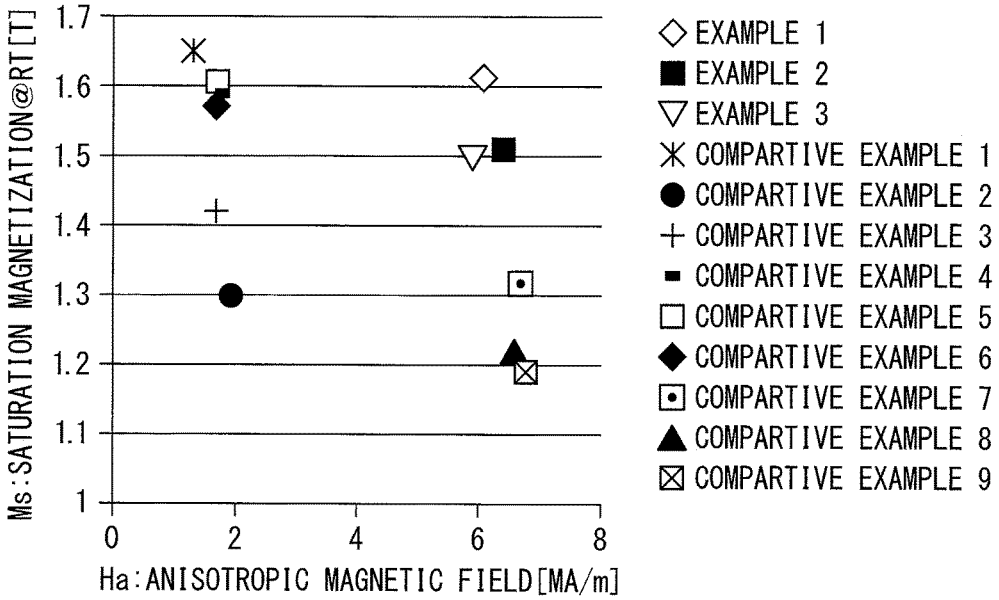
FIG. 6 is a graph illustrating the results from measuring the saturation magnetization (room temperature) and the anisotropic magnetic field in Examples 1 to 3 and Comparative Examples 1 to 10.
Figure 7:
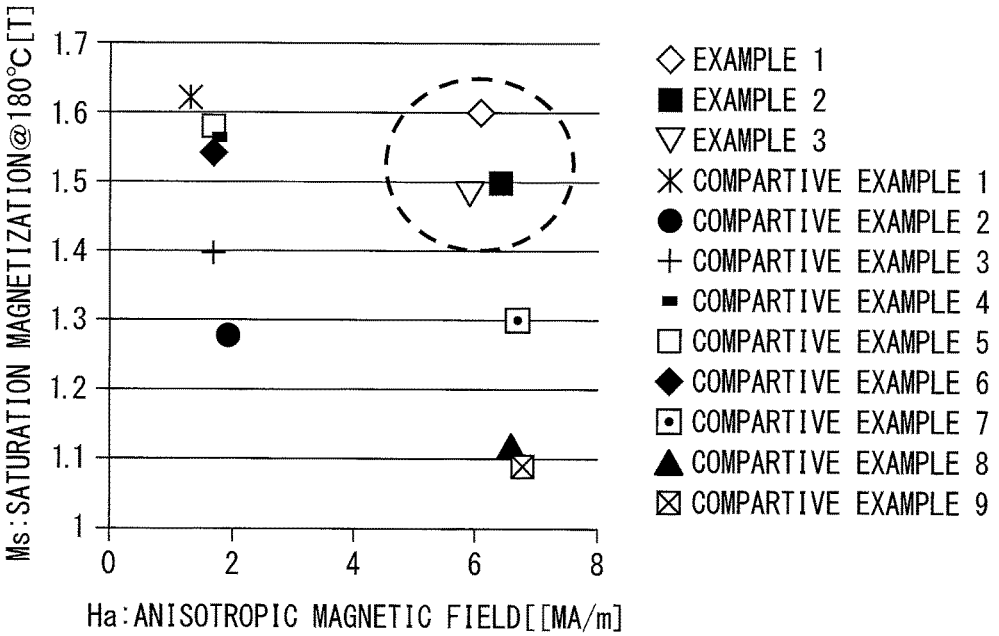
FIG. 7 is a graph illustrating the results from measuring the saturation magnetization (180° C.) and the anisotropic magnetic field in Examples 1 to 3 and Comparative Examples 1 to 10.

As apparent from the results shown in Table 1 and FIGS. 6 and 7, when the Ti amount is less than 7.7 atom %, a high value of saturation magnetization is exhibited at room temperature and 180° C. In particular, the value of saturation magnetization at 180° C. is significantly higher than the saturation magnetization (1.3 T) of NdFeB at 180° C. On the other hand, in Samples 1 to 6 of Comparative Example where a rare earth element having a negative Stevens factor, such as Nd or Ce, is used instead of Sm, a large anisotropic magnetic field is not obtained. In Samples 7 and 8 of Comparative Example where the Ti content by percentage is as large as 7.7, the saturation magnetization is low.

Here, in the crystal structure, when hexagons A, B and C are defined as:

A: a six-membered ring centering on a rare earth atom $R^1$ and consisting of Fe (8i) and Fe(8j) sites, B: a six-membered ring centering on an Fe (8i)-Fe (8i) dumbbell and consisting of Fe (8i) and Fe(8j) sites, and C: a six-membered ring centering on an Fe (8i)- rare earth atom line and consisting of Fe (8j) and Fe(8f) sites, the length Hex(A) in the axis a direction of hexagon A is estimated from Table 1 to be 0.618 nm in the conventional magnetic compound (Comparative Example 8), but it is understood that when Ti is substituted by Fe and Sm is substituted by Zr, the value above decreases. The reason therefor is considered to be that when the Ti amount is decreased, a Ti atom of the 8i site of hexagon A is replaced by an Fe atom having a small atomic radius to deteriorate the size balance of hexagon A and disturb stable formation of a 1-12 phase but since the size balance was compensated for by substituting for the Sm atom by Zr having a smaller atomic radius, a 1-12 phase could be produced, despite decrease in the Ti amount.

Examples 4 and 5

Figure 8:
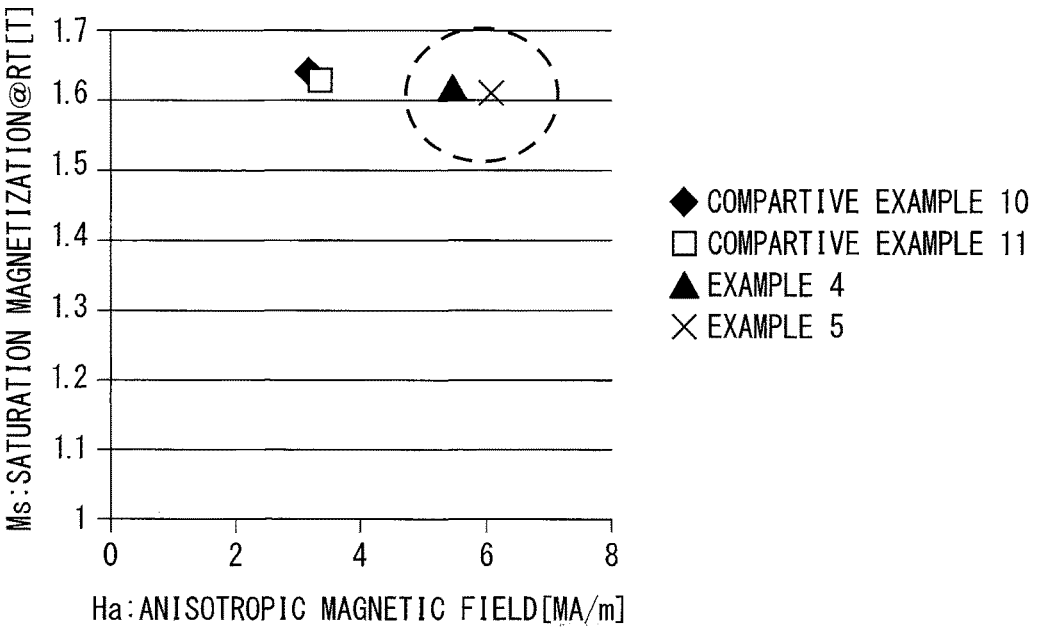
FIG. 8 is a graph illustrating the results from measuring the saturation magnetization (room temperature) and the anisotropic magnetic field in Examples 4 and 5 and Comparative Examples 11 and 12.
Figure 9:
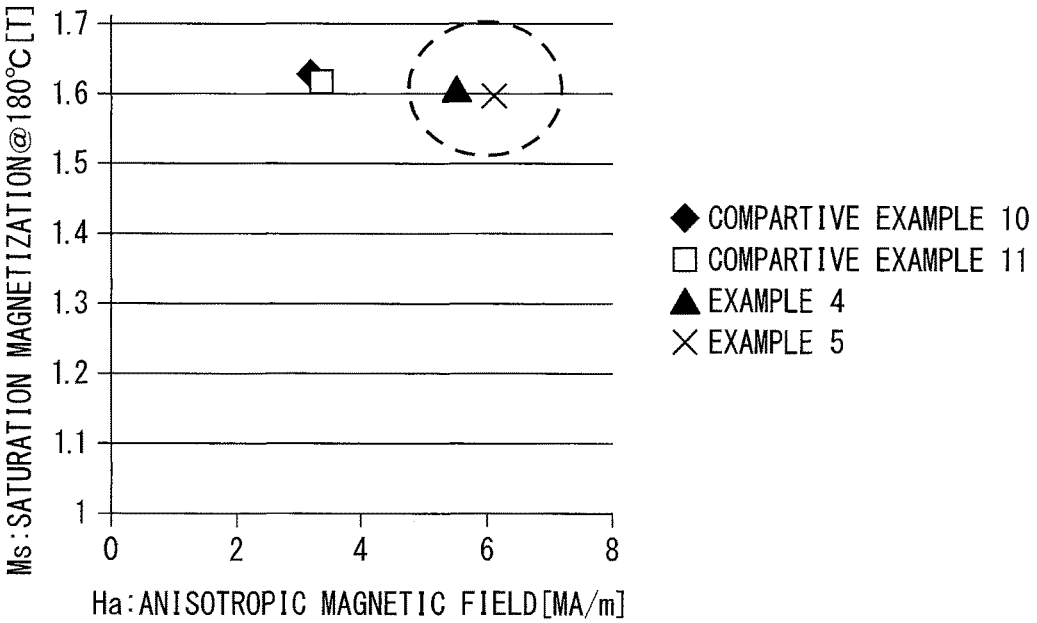
FIG. 9 is a graph illustrating the results from measuring the saturation magnetization (180° C.) and the anisotropic magnetic field in Examples 4 and 5 and Comparative Examples 11 and 12.

Molten alloys aimed for the manufacture of a compound having the composition shown in Table 2 below were prepared, and each was quenched at a rate of $10^4$ K/sec by a strip casting method to prepare a quenched flake. In Example 5, the flake was then subjected to a heat treatment in an Ar atmosphere at 1,200° C. for 4 hours. Subsequently, the flake was crushed by means of a cutter mill in an Ar atmosphere, and particles having a particle diameter of 30 μm or less were collected. In the same manner as in Example 1, the obtained particle was measured for the size and area percentage of α-(Fe, Co) phase, and the volume percentage was calculated. In addition, magnetic characteristic evaluation (VSM) and crystal structure analysis (XRD) of the obtained particle were performed. The results are shown in Table 2 and FIGS. 8 and 9.

Comparative Examples 10 and 11

Each of alloys aimed for the manufacture of a compound having the composition shown in Table 2 below was arc-melted and cooled at a rate of 50 K/sec to prepare a flake. In Comparative Example 11, the flake was then subjected to a heat treatment in an Ar atmosphere at 1,200° C. for 4 hours. Subsequently, the flake was crushed by means of a cutter mill in an Ar atmosphere, and particles having a particle diameter of 30 μm or less were collected. The obtained particle was nitrided at 450° C. for 4 hours in a nitrogen gas with purity of 99.99%. Magnetic characteristic evaluation (VSM) and crystal structure analysis (XRD) of the obtained particle were performed, and the results are shown in Table 2 and FIGS. 8 and 9 together with the results from measuring the size and area fraction of α-(Fe, Co) phase in the same manner as in Example 1.

As seen from the results above, the size of α-(Fe, Co) phase and the volume percentage thereof are decreased in the order of Comparative Example 10 (arc melting)→Comparative Example 11 (arc melting+homogenization heat treatment)→Example 4 (quenching)→Example 5 (quenching+homogenization heat treatment). It is considered that quenching allows the α-(Fe, Co) phase to become fine and be decreased in the precipitation amount and furthermore, allows the entire structure to become fine and undergo homogeneous dispersion and the properties are thereby enhanced. In addition, it is considered that by further performing a heat treatment after cooling, homogenization of the fine structure proceeds and the proportion of α(Fe, Co) phase is reduced, as a result, the anisotropic magnetic field is more enhanced. In this way, even when the Ti amount is decreased, precipitation of the α-(Fe, Co) phase is suppressed by quenching treatment and homogenization heat treatment, and an anisotropic magnetic field (about 6 MA/m) equivalent to that of conventional $SmFe_{11}Ti$ or NdFeB is developed, which makes it possible to manufacture a magnetic compound having a $ThMn_{12}$-type crystal structure and satisfying both properties of anisotropic magnetic field and saturation magnetization at high levels.

Examples 6 to 9 and Comparative Examples 12 to 19

Figure 10:
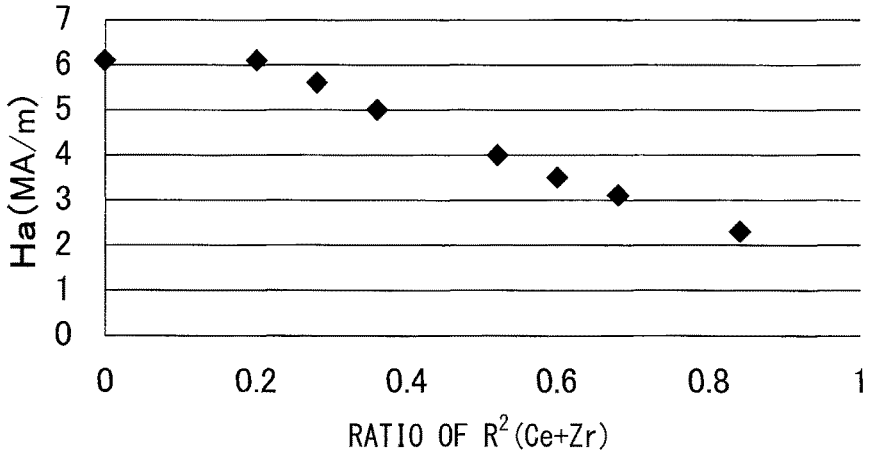
FIG. 10 is a graph illustrating the relationship between the amount of $R^2$ and the magnetic properties (anisotropic magnetic field) in Examples and Comparative Examples.
Figure 11:
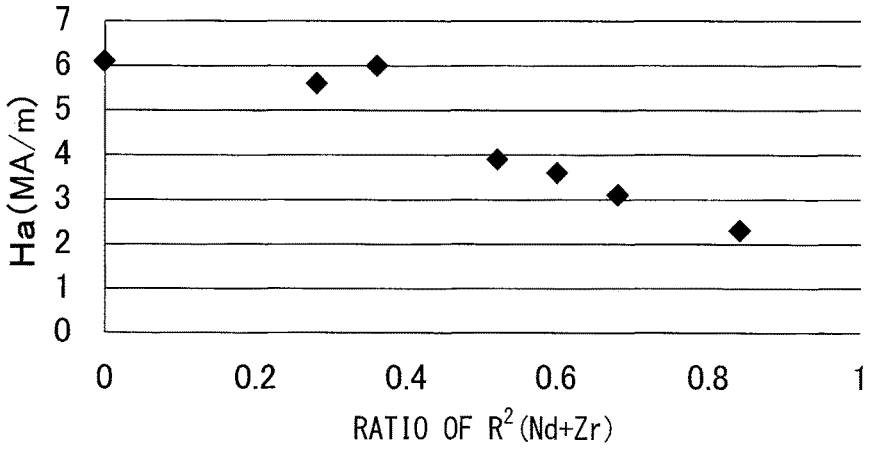
FIG. 11 is a graph illustrating the relationship between the amount of $R^2$ and the magnetic properties (anisotropic magnetic field) in Examples and Comparative Examples.

Molten alloys aimed for the manufacture of a compound having the composition shown in Table 3 below were prepared, and each was quenched at a rate of $10^4$ K/sec by a strip casting method to prepare a quenched flake. The flake was subjected to a heat treatment in an Ar atmosphere at 1,200° C. for 4 hours and then crushed by means of a cutter mill in an Ar atmosphere, and particles having a particle diameter of 30 μm or less were collected. Magnetic characteristic evaluation (VSM) and crystal structure analysis (XRD) of the obtained particle were performed. The results are shown in Table 3 and FIGS. 10 and 11.

TABLE 2

| | Composition | Melting Method, Cooling Rate | Homogenization Heat Treatment | Size of α(Fe, Co) (μm) | Volume Percentage of α(Fe, Co) (%) | Anisotropic Magnetic Field (MA/m) | Saturation Magnetization @RT (T) | Saturation Magnetization @180° C. (T) | Hex. (A) (nm) |
|---|---|---|---|---|---|---|---|---|---|
| Comparative Example 10 | $Sm_{7.7}(Fe_{0.75}Co_{0.25})_{88.5}Ti_{3.8}$ | arc melting 50 K/s | none | 8 | 18.2 | 3.2 | 1.64 | 1.63 | 0.612 |
| Comparative Example 11 | $Sm_{7.7}(Fe_{0.75}Co_{0.25})_{88.5}Ti_{3.8}$ | arc melting 50 K/s | 1200° C., 4 hours | 5 | 12.3 | 3.4 | 1.63 | 1.62 | 0.612 |
| Example 4 | $Sm_{7.7}(Fe_{0.75}Co_{0.25})_{88.5}Ti_{38}$ | quenching $10^4$ K/s | none | 1.5 | 8.4 | 5.5 | 1.62 | 1.61 | 0.612 |
| Example 5 | $Sm_{7.7}(Fe_{0.75}Co_{0.25})_{88.5}Ti_{38}$ | quenching $10^4$ K/s | 1200° C. 4 hours | 1.3 | 5.5 | 6.1 | 1.61 | 1.60 | 0.612 |

TABLE 3

| | Composition | Ratio of $R^2$ | Anisotropic Magnetic Field [MA/m] | Saturation Magnetization @RT (T) | Saturation Magnetization @180° C. (T) | Hex. (A) (nm) |
|---|---|---|---|---|---|---|
| Example 1 | $Sm_{7.7}(Fe_{0.75}Co_{0.25})_{88.5}Ti_{3.8}$ | 0 | 6.1 | 1.61 | 1.60 | 0.612 |
| Example 2 | $(Sm_{0.8}Zr_{0.2})_{7.7}(Fe_{0.75}Co_{0.25})_{86.5}Ti_{5.8}$ | 0.2 | 6.1 | 1.61 | 1.60 | 0.607 |
| Example 6 | $(Sm_{0.72}Ce_{0.08}Zr_{0.2})_{7.7}(Fe_{0.75}Co_{0.25})_{86.5}Ti_{5.8}$ | 0.28 | 5.6 | 1.44 | 1.43 | 0.607 |
| Example 7 | $(SM_{0.64}Ce_{0.16}Zr_{0.2})_{7.7}(Fe_{0.75}Co_{0.25})_{86.5}Ti_{5.8}$ | 0.36 | 5 | 1.43 | 1.42 | 0.608 |
| Comparative Example 12 | $(Sm_{0.48}Ce_{0.32}Zr_{0.2})_{7.7}(Fe_{0.75}Co_{0.25})_{86.5}Ti_{5.8}$ | 0.52 | 4 | 1.42 | 1.41 | 0.608 |
| Comparative Example 13 | $(Sm_{0.4}Ce_{0.4}Zr_{0.2})_{7.7}(Fe_{0.75}Co_{0.25})_{86.5}Ti_{5.8}$ | 0.6 | 3.5 | 1.42 | 1.41 | 0.609 |
| Comparative Example 14 | $(Sm_{0.32}Ce_{0.48}Zr_{0.2})_{7.7}(Fe_{0.75}Co_{0.25})_{86.5}Ti_{5.8}$ | 0.68 | 3.1 | 1.41 | 1.40 | 0.609 |
| Comparative Example 15 | $(Sm_{0.16}Ce_{0.64}Zr_{0.2})_{7.7}(Fe_{0.75}Co_{0.25})_{86.5}Ti_{5.8}$ | 0.84 | 2.3 | 1.39 | 1.38 | 0.610 |
| Example 8 | $(Sm_{0.72}Nd_{0.08}Zr_{0.2})_{7.7}(Fe_{0.75}Co_{0.25})_{86.5}Ti_{5.8}$ | 0.28 | 5.6 | 1.45 | 1.44 | 0.607 |
| Example 9 | $(Sm_{0.64}Nd_{0.16}Zr_{0.2})_{7.7}(Fe_{0.75}Co_{0.25})_{86.5}Ti_{5.8}$ | 0.36 | 6 | 1.44 | 1.43 | 0.608 |
| Comparative Example 16 | $(Sm_{0.48}Nd_{0.32}Zr_{0.2})_{7.7}(Fe_{0.75}Co_{0.25})_{86.5}Ti_{5.8}$ | 0.52 | 3.9 | 1.5 | 1.49 | 0.608 |
| Comparative Example 17 | $(Sm_{0.4}Nd_{0.4}Zr_{0.2})_{7.7}(Fe_{0.75}Co_{0.25})_{86.5}Ti_{5.8}$ | 0.6 | 3.6 | 1.49 | 1.48 | 0.609 |
| Comparative Example 18 | $(Sm_{0.32}Nd_{0.48}Zr_{0.2})_{7.7}(Fe_{0.75}Co_{0.25})_{86.5}Ti_{5.8}$ | 0.68 | 3.1 | 1.5 | 1.49 | 0.609 |
| Comparative Example 19 | $(Sm_{0.16}Nd_{0.64}Zr_{0.2})_{7.7}(Fe_{0.75}Co_{0.25})_{86.5}Ti_{5.8}$ | 0.84 | 2.4 | 1.51 | 1.50 | 0.610 |

In all samples, almost no α-(Fe, Co) phase was detected, and the size and volume percentage of the phase were 1 μm or less and 3.5% or less, respectively. Along with addition of a rare earth element having a negative Stevens factor, the anisotropic magnetic field tends to be reduced. In the application to a magnet, when it is used in a high-temperature environment of 100° C. or more, the Ha value is preferably 5 MA/m or more within which a high coercive force can be expected. In the case of using the magnet in the vicinity of room temperature, a large coercive force is not required and therefore, it may also be possible to have an Ha value of about 3 MA/m and configure a magnetic composition where the cost and resource risk are reduced by adding surplus or low-cost Ce or Zr to the raw material. Consequently, the fraction of $R^2$ is 0.7 or less, more preferably 0.4 or less.

According to the present invention, in a compound having a $ThMn_{12}$-type crystal structure, represented by the following formula: $(R^1_{(1-x)}R^2_x)_a(Fe_{(1-y)}Co_y)_bT_cM_d$, an element having a positive Stevens factor is used as the rare earth element $R^1$, so that uniaxial magnetic anisotropy that is essential in a rare earth-based magnet can be imparted. In addition, the cooling rate of molten alloy is adjusted in the production process so as to decrease the amount of α-(Fe, Co) phase precipitated at the time of cooling and precipitate many $ThMn_{12}$-type crystals, so that the anisotropic magnetic field can be enhanced. Furthermore, the size specified in (2) above is employed, and the size balance of respective hexagons is thereby enhanced, so that a $ThMn_{12}$-type crystal structure can be stably formed. Moreover, the ratio of magnetic elements of Fe and Co is increased by decreasing the T amount and in turn, magnetization is improved.

What is claimed is:

1. A magnetic compound, its composition being represented by the formula in atomic percentage:

$$(R^1_{(1-x)}R^2_x)_a(Fe_{(1-y)}Co_y)_bT_cM_d$$

wherein $R^1$ is Sm, $R^2$ is Zr,

T is Ti,

M is one or more unavoidable impurity elements, $0 \le x \le 0.7$, $0 \le y \le 0.7$, $4 \le a \le 20$, $b = 100-a-c-d$, $0 < c < 7.7$, and $0 \le d \le 2$, and wherein the magnetic compound has a $ThMn_{12}$-type crystal structure and an α-(Fe, Co) phase of less than 12.3% in volume fraction, wherein when hexagons A, B and C are defined as:

A: a six-membered ring centering on a rare earth atom $R^1$ and consisting of Fe (8i) and Fe(8j) sites, B: a six-membered ring centering on an Fe (8i)-Fe (8i) dumbbell and consisting of Fe (8i) and Fe(8j) sites, and C: a six-membered ring centering on an Fe (8i)-rare earth atom line and consisting of Fe(8j) and Fe(8f) sites, the $ThMn_{12}$--type crystal structure has these hexagons A, B and C and the length in the axis a direction of hexagon A is 0.607 nm or more and 0.612 nm or less.

2. The magnetic compound according to claim 1, wherein $0 \le x \le 0.4$.

3. The magnetic compound according to claim 1, wherein $4 \le a \le 15$.

4. The magnetic compound according to claim 1, wherein $3.8 \le c < 7.7$.

5. The magnetic compound according to claim 1, wherein $0 \le y \le 0.4$.

6. The magnetic compound according to claim 1, wherein the volume fraction of α-(Fe, Co) phase is 10% or less.

7. A method for producing the magnetic compound according to claim 1, comprising:

a step of preparing a molten alloy, its composition being represented by the formula in atomic percentage:

$$(R^1_{(1-x)}R^2_x)_a(Fe_{(1-y)}Co_y)_bT_cM_d$$

wherein $R^1$ is Sm, $R^2$ is Zr,

T is Ti, $0 \le x \le 0.7$, $0 \le y \le 0.7$, $4 \le a \le 20$ $b = 100-a-c-d$, $0<c<7.7$, and $0 \leq d \leq 2$, and a step of quenching the molten alloy at a rate of $1\times10^2$ to $1\times10^7$ K/sec.

8. The method according to claim 7, further comprising a step of performing a heat treatment at 800 to 1,300° C. for 2 to 120 hours after the quenching step.

9. The method according to claim 7, wherein $0 \leq x \leq 0.4$.

10. The method according to claim 7, wherein $4 \leq a \leq 15$.

11. The method according to claim 7, wherein $3.8 \leq c < 7.7$.

12. The method according to claim 7, wherein $0 \leq y \leq 0.4$.

* * * * *